United States Patent [19]

Wallis

[11] 4,089,203

[45] May 16, 1978

[54] WORKPIECE TRANSFER MECHANISM

[76] Inventor: Bernard J. Wallis, 25200 Trowbridge Ave., Dearborn, Mich. 48124

[21] Appl. No.: 674,407

[22] Filed: Apr. 7, 1976

[51] Int. Cl.[2] ..... B21D 43/04; B21D 43/05; B21D 43/10; B21J 13/08

[52] U.S. Cl. ..... 72/405; 72/422; 113/113 R; 198/742; 214/1 BB

[58] Field of Search ..... 72/422, 405, 419–421; 10/166, 12 T, 72 T, 76 T; 214/1 BB, 1 BC; 198/740, 742; 113/113 R

[56] References Cited

U.S. PATENT DOCUMENTS

| | | | |
|---|---|---|---|
| 1,880,112 | 9/1932 | Shmyroff et al. | 198/740 |
| 1,987,101 | 1/1935 | Fabrice | 72/348 X |
| 3,057,312 | 10/1962 | Hatch | 113/133 R X |
| 3,295,701 | 1/1967 | Alexander | 10/12 T X |
| 3,411,636 | 11/1968 | Wallis | 294/87.26 |
| 3,434,328 | 3/1969 | Taniguchi et al. | 72/405 |
| 3,513,967 | 5/1970 | Sheppard | 198/740 |
| 3,552,180 | 1/1971 | Hall et al. | 214/1 BB X |
| 3,613,331 | 10/1971 | Garrett | 198/740 X |
| 3,620,381 | 11/1971 | McCaughey | 214/1 BB |
| 3,661,247 | 5/1972 | Wallis | 198/740 |
| 3,782,561 | 1/1974 | Orii | 214/1 BB |
| 3,800,583 | 4/1974 | Miller | 113/113 R |
| 3,805,582 | 4/1974 | Logan | 72/405 |
| 3,885,680 | 5/1975 | Rosenberger | 214/1 BB |
| 3,939,992 | 2/1976 | Mikulec | 214/1 BB |
| 4,038,862 | 8/1977 | Yamashita | 72/421 |

FOREIGN PATENT DOCUMENTS

| | | | |
|---|---|---|---|
| 398,319 | 3/1961 | Switzerland | 72/419 |

*Primary Examiner*—C.W. Lanham
*Assistant Examiner*—D. M. Gurley
*Attorney, Agent, or Firm*—Barnes, Kisselle, Raisch & Choate

[57] ABSTRACT

A stamping press having a workpiece transfer mechanism connected thereto. The transfer mechanism includes a reciprocating carriage having a rigid cross arm thereon extending transverse to the path of travel of the carriage. A pair of laterally spaced, parallel finger bars extend lengthwise of the path of travel of the carriage and have one end thereof fixedly mounted on and supported on the opposite ends of the cross arm such as to reciprocate with the carriage. The other ends of the finger bars are slideably supported adjacent the die in the press. The finger bars have fingers thereon which are movable preferably in a vertical plane between work-engaging and work-releasing positions. In one embodiment the fingers are fixedly mounted on the finger bars and the finger bars are rotated to actuate the fingers in a vertical plane between work-engaging and work-releasing position. In another embodiment the fingers are raised and lowered in a vertical plane parallel to the axis of each finger bar.

15 Claims, 11 Drawing Figures

FIG. 3
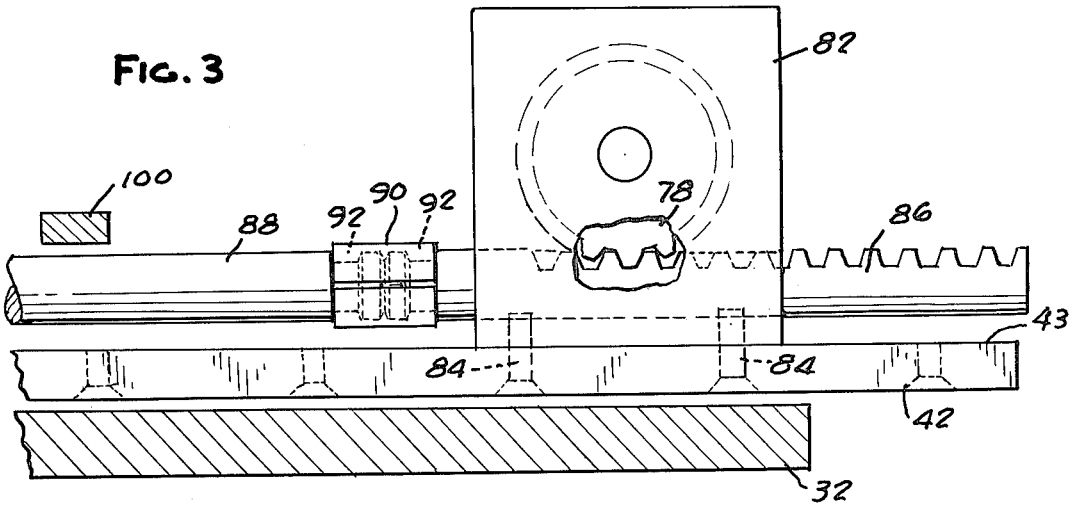
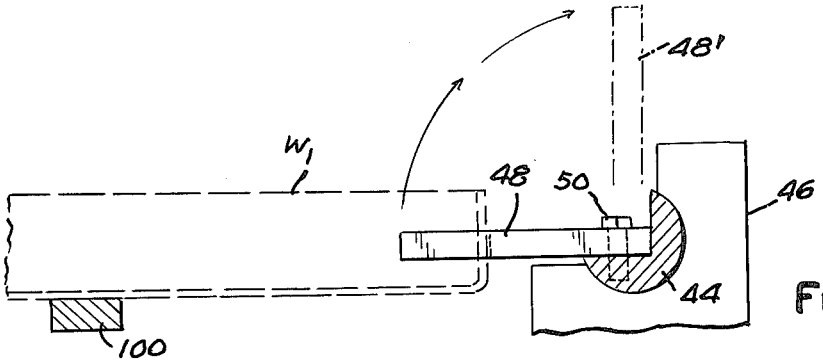
FIG. 4
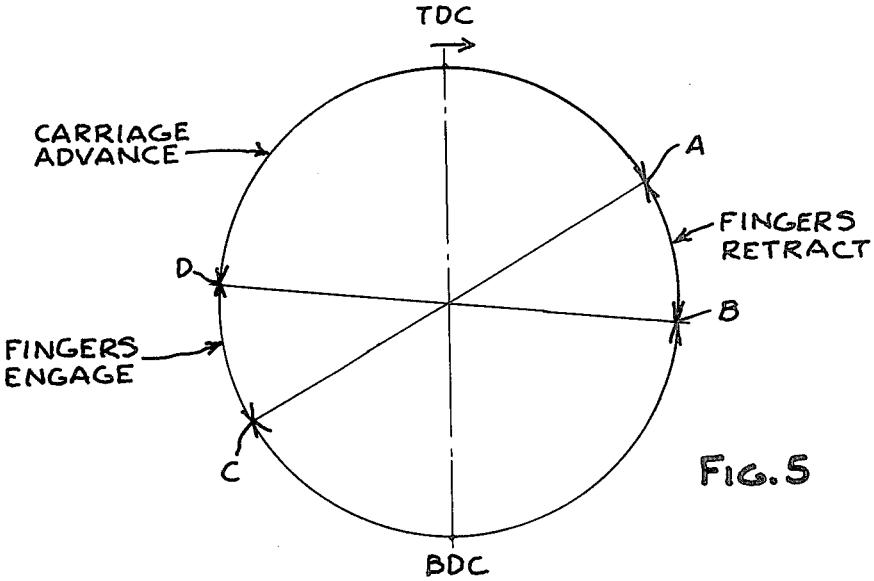
FIG. 5

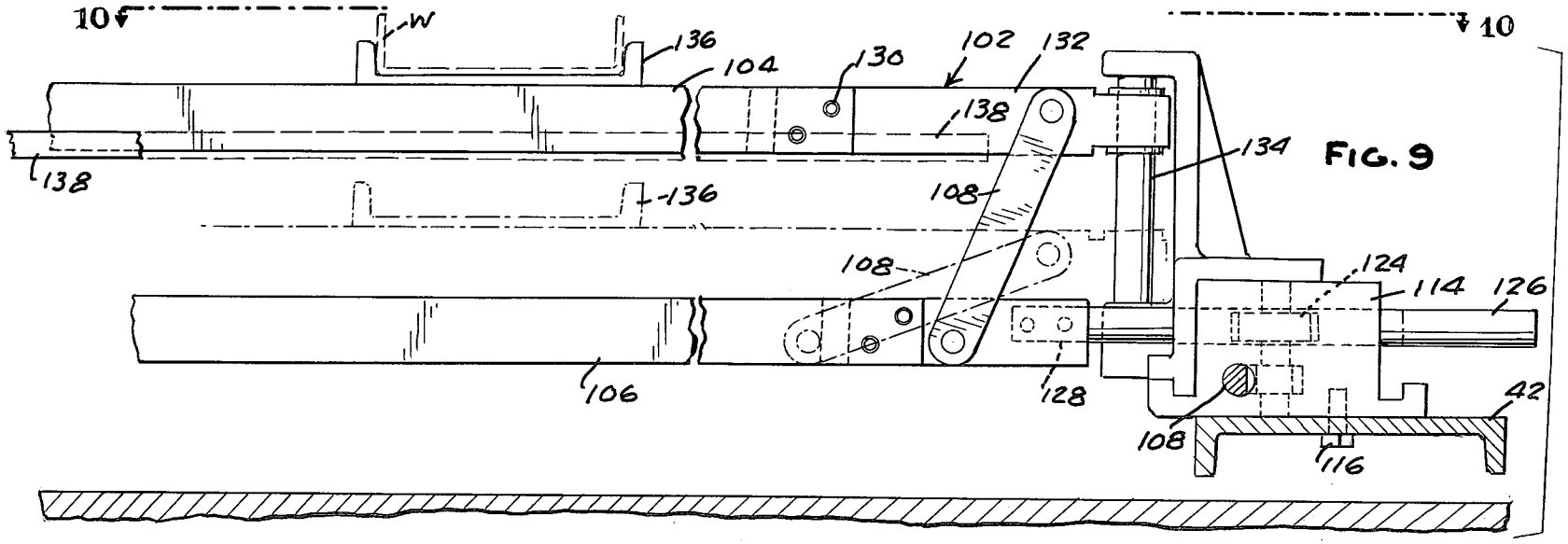
FIG. 9
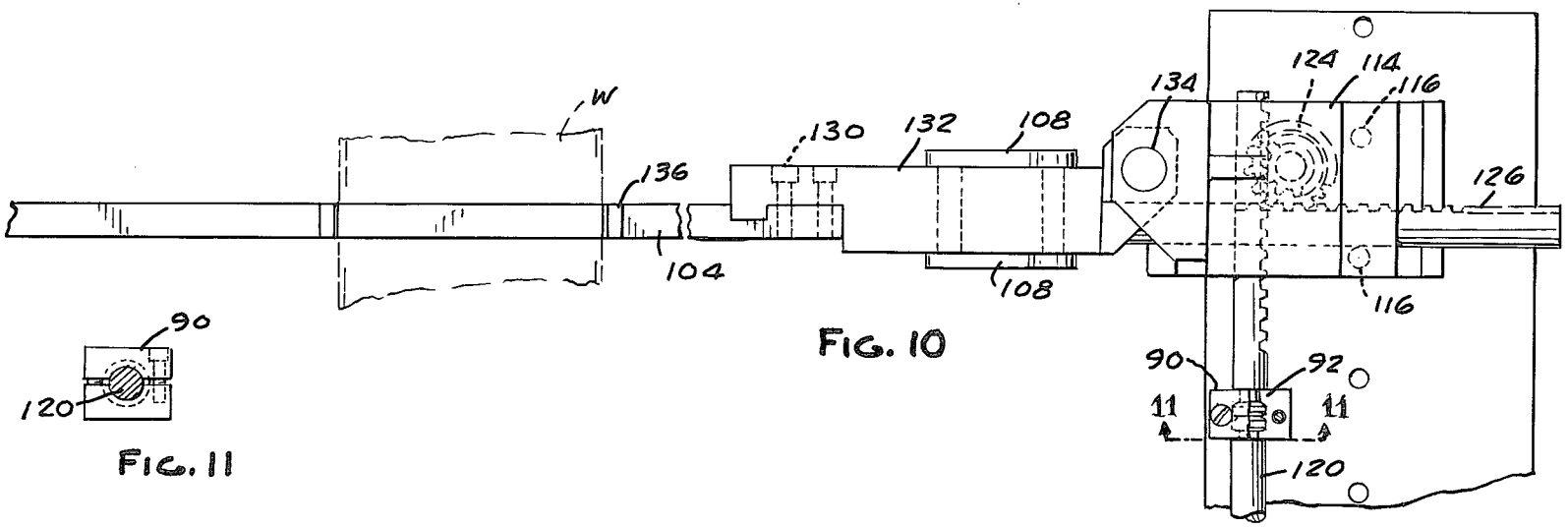
FIG. 10
FIG. 11

WORKPIECE TRANSFER MECHANISM

This invention relates to a workpiece transfer mechanism for stamping presses.

From the standpoint of safety and economy it is highly desirable in connection with forming workpieces by stamping to load the workpiece into the press and/or remove it from the press by an automated transfer mechanism. Such transfer mechanisms are normally designed and constructed for use with a particular press and a particular workpiece. A transfer mechanism of conventional design frequently becomes obsolete or at least requires very substantial rebuilding when used with a different press or with a different workpiece. In addition, conventional transfer mechanisms for loading and unloading workpieces require substantial space both within the die area of the press and adjacent the press.

The primary object of this invention resides in the provision of a transfer mechanism for a stamping press which requires a minimum of space in the die area and a minimum of space adjacent the press.

A further object of the invention resides in a transfer mechanism of the type described which is designed so that the mechanism can be readily adapted for use with different presses or different workpieces by replacing or changing the position of a minimum number of components.

More specifically, the transfer mechanism of this invention comprises a base plate adapted to be positioned adjacent one side of a press and on which a carriage is mounted for reciprocation through a set stroke toward and away from the die in the press. The carriage is reciprocated by a drive mechanism also supported on the base plate. A support arm is fixedly mounted on the carriage and extends outwardly from opposite sides thereof in a direction transversely of the direction of travel of the carriage. A pair of parallel finger bars extend lengthwise of the carriage and have workpiece-engaging fingers mounted thereon at spaced intervals. The finger bars are fixedly supported at one end on the opposite end portions of the transverse support arm by means which enable the finger bars to be readily detached from or adjusted laterally on the support arm. The opposite ends of the finger bars are supported for sliding movement in a direction parallel to the path of travel of the carriage by fixedly mounted supporting guides. The means mounting the finger bars on the support arm include means for actuating the work-engaging fingers to and from the workpiece engaging position. This movement is preferably either rotation of the finger bars to revolve the fingers in vertical planes extending transversely of the finger bars or vertically raising and lowering a portion of the finger bars, as distinguished from lateral horizontal movement of fingers or finger bars toward and away from the die. Thus, with a transfer mechanism of the present invention, when it is desired to adapt it to a workpiece of different shape or different dimensions, it is normally only necessary to disconnect the finger actuating mechanism, relocate the finger bars on the support arm or substitute different finger bars, and then reconnect the finger actuating mechanism, the remaining components of the transfer mechanism being left substantially in tact and undisturbed. Likewise, when it is desired to use the transfer mechanism with a different press, the mechanism can be removed from one press and mounted on another as an integral unit.

IN THE DRAWINGS:

FIG. 3 is a sectional view along line 3—3 in FIG. 2;

FIG. 4 is a sectional view along line 4—4 in FIG. 2;

FIG. 5 is a timing diagram showing a complete cycle of the transfer mechanism in relation to reciprocation of the press ram;

FIG. 9 is a sectional view along line 9—9 in FIG. 6;

FIG. 10 is a view along line 10—10 in FIG. 9; and

FIG. 11 is a sectional view along line 11—11 in FIG. 10.

Figure 1:
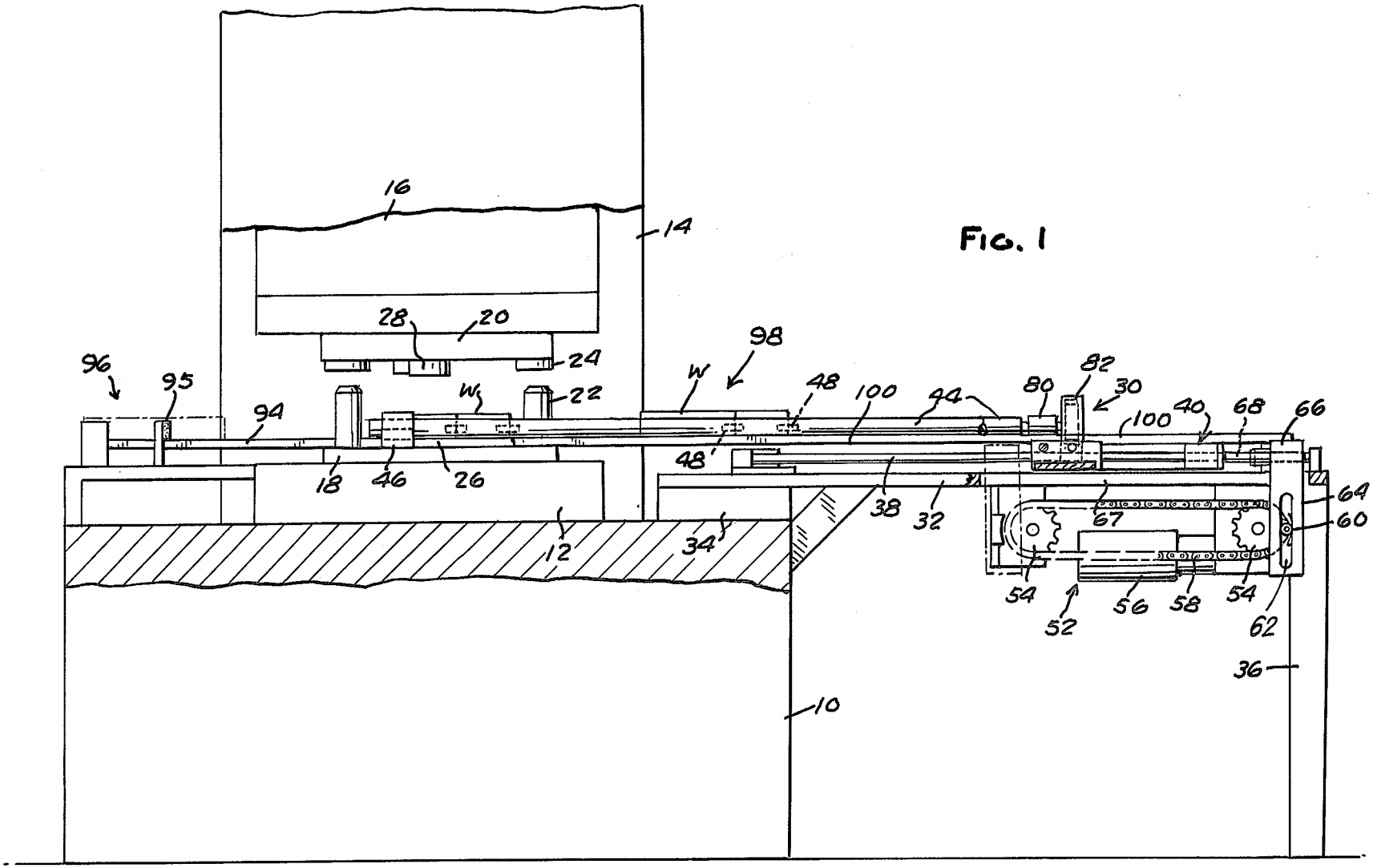
FIG. 1 is a side elevational view, partly in section, of a metal stamping press with a workpiece transfer mechanism embodying this invention connected thereto.

Referring first to FIGS. 1 to 4, there is shown a stamping press having a base 10 on the bed of which is mounted a die support 12. The press includes uprights 14 on which is mounted a vertically reciprocating ram 16. A lower die plate 18 is mounted on die support 12 and an upper die plate 20 is mounted on ram 16. Die plate 18 is provided with conventional guide pins 22 which telescope into guide bushings 24 on upper die plate 20 when ram 16 descends. A lower die is designated 26 and an upper die is designated 28. The portion of the press extending laterally between the two guide pins 22 is hereinafter referred to as the "die area of the press".

Figure 2:
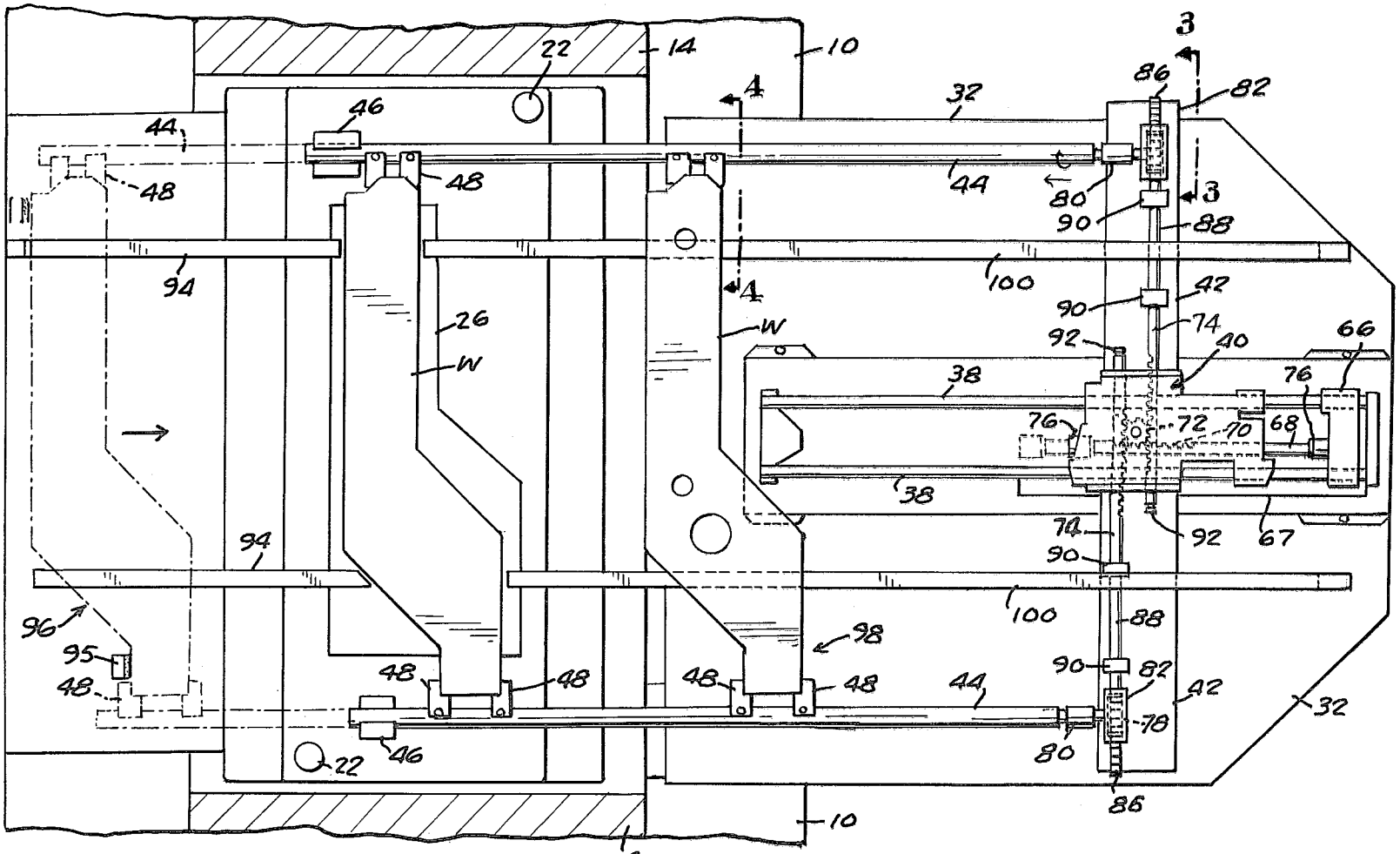
FIG. 2 is a plan view of the arrangement illustrated in FIG. 1 as viewed from directly above the transfer mechanism.

The transfer mechanism of the present invention is generally designated 30 and includes a base plate 32 having one end secured to the press base as at 34 and its opposite end supported by legs 36. As is shown in FIG. 2, there is mounted on the top side of base plate 32 a pair of parallel guide bars 38 on which a carriage 40 is supported for reciprocation in a horizontal plane toward and away from the die in the press. A cross arm 42 having a flat upper face 43 is fixedly mounted on carriage 40 and extends transversely on opposite sides thereof. Adjacent the opposite ends of cross arm 42 there is mounted on the top face thereof a pair of finger bars 44 which extend in parallel relation from cross arm 42 into the die area of the press so as to straddle the die. Finger bars 44 are mounted on cross arm 42 to reciprocate with carriage 40. The free ends of finger bars 44 are slideably engaged by guide blocks 46 fixedly mounted on die plate 18. As can be seen from FIG. 2, finger bars 44 are spaced apart such that they are located laterally inwardly of guide pins 22. Each finger bar is provided with two spaced pair of work-engaging fingers 48, the fingers in each pair being shaped and spaced apart to engage the opposite ends of workpieces W. Fingers 48 are mounted on their respective bars by screws 50.

The present invention is not limited to any specific form of carriage 40 nor any specific drive mechanism for reciprocating the carriage. In the arrangement illustrated carriage 40 is reciprocated by a chain drive 52 which is best illustrated in FIG. 1. Chain drive 52 incorporates a pair of spaced sprockets 54, one of which is driven by a motor 56. An endless chain 58 extends around sprockets 54 and has a roller 60 fixed to one link of the chain. Roller 60 is engaged in a vertical slot 62 on a yoke 64 depending from a slide 66 through an elongated slot 67 in base plate 32. Slide 66 is mounted to reciprocate on guide bars 38. An actuator shaft 68 is fixed to slide 66 and extends through carriage 40.

The carriage 40 illustrated in the drawings is constructed and operates generally in the same manner as the carriage illustrated in my U.S. Pat. No. 3,411,636. With a carriage of this type, actuator shaft 68 includes a gear rack portion 70 which meshes with a gear set 72 in the carriage housing. When shaft 68 is reciprocated axially relative to carriage 40 gear set 72 is rotated in opposite directions. A pair of finger control rods 74 have gear rack portions which mesh with gear set 72 so that both rods 74 are simultaneously reciprocated in opposite directions in response to axial movement of shaft 68 relative to carriage 40. A pair of enlarged bushings 76 are fixed to the opposite ends of shaft 68. When slide 66 is shifted to the left as viewed in FIGS. 1 and 2, carriage 40 initially remains stationary and the two rods 74 are shifted axially in a direction inwardly of the two finger bars 44. When the bushing 76 at the right end of shaft 68 abuts carriage 40, it releases latches (not illustrated) locking the carriage to base plate 32 in the advanced position illustrated in FIG. 2 and shifts the carriage on guide bars 38 to a retracted position determined by the stroke of yoke 64 where the carriage is again locked on base plate 32 by latches (not illustrated). Thereafter, when yoke 64 is displaced in a direction towards the right as viewed in FIGS. 1 and 2, the two control rods 74 are shifted axially outwardly towards their respective finger bars 44 until the bushing 76 at the left end of shaft 68 abuts carriage 40. After this initial movement of shaft 68 in the direction towards the right, bushing 76 at the left end of shaft 68 abuts the carriage, releases the carriage locking latches and shifts the carriage from the retracted position back to the advanced position shown in FIGS. 1 and 2.

The end of each finger bar adjacent cross arm 42 is connected to an output gear 78 by a coupling 80, the coupling being of the split bushing type which is readily removable and which keys each gear 78 to its respective finger bar 44. Each gear 78 is journalled in a housing 82 secured on the top face 43 of cross arm 42 by screws 84 (FIG. 3). Within each housing 82 there is slideably arranged a short input stub shaft in the form of a gear rack 86 meshing with gear 78. An adapter or finger-operating rod 88 extends between the end of each gear rack 86 and the adjacent end of the finger control rods 74. Adapter rods 88 are connected by split couplings 90 with the axially aligned ends of input gear racks 86 and the output ends of control rods 74.

In the arrangement illustrated it will be noted that, since control rods 74 are reciprocated simultaneously in opposite directions ans since both gear racks 86 engage gear 78 on the lower side thereof, both finger bars 44 are rotated simultaneously in opposite directions about their longitudinal axes. However, it will be noted that finger control rods 74 project outwardly beyond both sides of carriage 40 and each is provided at the opposite ends thereof with a groove 92 or other configuration for enabling either end to serve as an output member connected to another rod by a split coupling such as shown at 90. Thus, instead of connecting adapter rods 88, one to each control rod 74, both adapter rods 88 can be connected to the opposite ends of the same control rod 74. In this event the housings 82 would be designed one for left-hand and the other for right-hand operation. Gear rack 86 would be disposed below gear 78 in one housing and above gear 78 in the other housing. Such an arrangement would still cause both finger bars 44 to rotate simultaneously in opposite directions. By having control rods project from opposite sides of the carriage housing both or only one of the control rods may be operatively connected to the finger bars as economy or the particular application dictates. In any event, the drive to the finger bars is such as to cause fingers 48 to rotate approximately 90° in a vertical plane between the work-engaging position shown in solid lines in FIGS. 2 and 4 to the work-releasing position shown in broken lines at 48' in FIG. 4.

It is clear that the reciprocation of carriage 40 and the rotation of finger bars 44 must be synchronized with the movement of the press ram 16. While the operating cycle may vary with the configuration of the workpiece, a typical cycle is illustrated in FIG. 5. The top and bottom dead center positions of the press ram are designated TDC and BDC, respectively. The chain drive for the carriage is such that at point A the carriage is in the advanced position and rotation of finger bars 44 is initiated in the work-releasing direction. At point B the fingers assume the position designated 48' in FIG. 4. Thereafter, as previously explained, carriage 40 shifts to the left as viewed in FIGS. 1 and 2 so that the ends of the finger bars 44 are retracted to the broken line position shown in FIG. 2. Fingers 48 adjacent the ends of bars 44 are then aligned with the opposite ends of a workpiece W deposited on a pair of support rails 94 against stops 95 at a loading station 96 on the side of the press opposite carriage 40. The other set of fingers on bars 44 are aligned with the opposite ends of the workpiece in the die. In the operating cycle illustrated in FIG. 5 this represents point C.

Thereafter with the carriage in the fully retracted position, movement of slide 66 initially causes the fingers to rotate to the work-engaging position, point D in FIG. 5, so that the fingers 48 engage the opposite ends of the workpiece at the load station 96 and the workpiece in the die. Continued movement of slide 66 toward the right causes the carriage to advance to the position shown in FIG. 2. Thus, the workpiece W at the die 26 is advanced to an unload position 98 where the workpiece rests upon a second set of horizontally disposed support rails 100. At the same time, the workpiece W at the loading station 96 is advanced to a position registering with die 26. As the press repeats the foregoing cycle successive workpieces will be transferred from loading station 96 into the die and from die 26 to unload station 98, the workpieces on support rails 100 being successively pushed by the preceding workpiece in a direction toward the right on rails 100.

While the transfer mechanism shown is designed to load and unload workpieces, it will be appreciated that if it is desired to merely load or unload workpieces, finger bars 44 can be shorter and guide blocks can be located on the opposite side of the die, or even on base plate 32, since either the load or unload station can be located at the position designated 98.

In the event that a batch of workpieces of shorter length are to be formed in the press it will be apparent that the transfer mechanism can be readily adapted to accommodate such shorter workpieces. For example, if couplings 90 are disconnected, the two finger bars 44 can be located closer together by relocating guide blocks 46 in the die area of the press and by relocating housings 82 on the same cross arm 42. In this event shorter finger-operating rods 88 would be substituted for those illustrated. The remaining components of the transfer mechanism would be unchanged. If required, finger bars 44 can be replaced with another set and fingers 48 can also be removed from finger bars 44 and replaced with another set spaced and shaped to accommodate the workpiece.

It will also be apparent that the transfer mechanism itself is an integral unit not integrally coupled to the press or die. Thus the whole transfer mechanism and its drive can be readily used with another press.

In FIGS. 6 to 11 I have shown a transfer mechanism which differs from that illustrated in FIGS. 1 to 4 primarily in the configuration and operation of the finger bars. In this arrangement the finger bars, which are generally designated 102, comprise an upper bar 104 and a lower bar 106 which are interconnected in parallelogram fashion by links 108. Each lower bar 106 is supported at the end thereof adjacent the die by guide rollers 110 mounted in a support block 112 located in the die area of the press. The other ends of bars 106 are supported on cross arm 42 by means of a housing 114 attached to the cross arm by screws 116. Within housing 114 there is arranged a input stub shaft in the form of a gear rack 118 connected to the finger control rods 74 by finger-operating rods 120 and couplings 90. Gear racks 118 mesh with a gear set 124 in each housing 114. A second output gear rack 126 in each housing 114 meshes with gear set 124 and is fixedly connected to one end of bar 106 as at 128. The upper bar 104 is connected as at 130 to a short bar 132 which is guided vertically on housing 114 by a post 134. The upper finger bar 104 has a plurality of work-engaging fingers 136 mounted thereon at spaced intervals along the length thereof.

Figures 6, 7, 8:
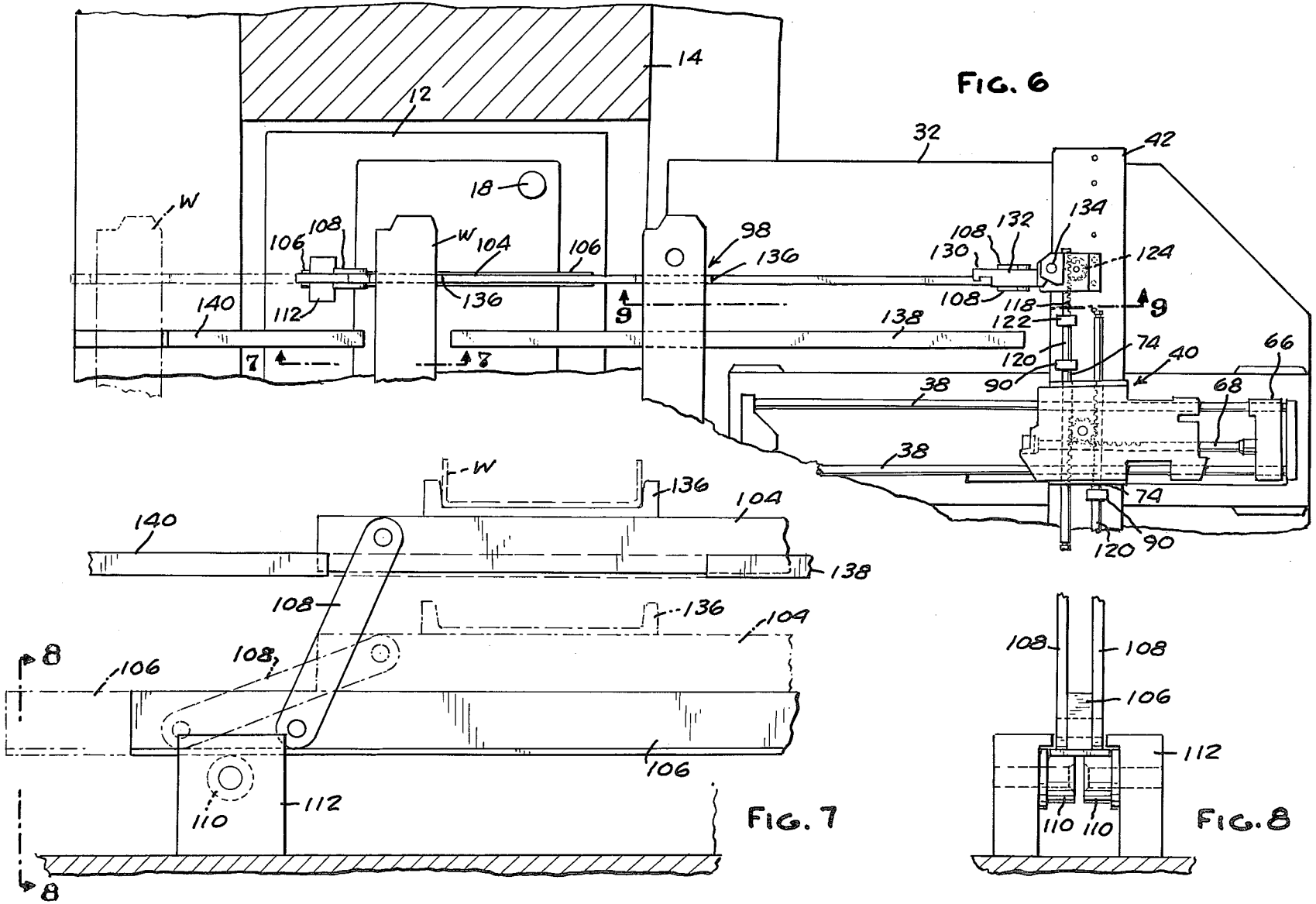
FIG. 6 is a fragmentary plan view similar to FIG. 2 and illustrating a slightly modified form of transfer mechanism.
FIG. 7 is a sectional view along line 7—7 in FIG. 6.
FIG. 8 is a sectional view along line 8—8 in FIG. 7.

With the carriage in the advanced position illustrated in FIG. 6 the upper bar 104 is in the raised position illustrated in FIGS. 7 and 9. When the slide 66 is moved towards the left from the position illustrated in FIG. 6, initially the two control rods 74 are shifted outwardly and the lower finger bars 106 are shifted toward the left as viewed in FIGS. 7 and 9. This causes the links 108 to lower the upper bars 104 to the broken line position shown in FIGS. 7 and 9 and deposit one workpiece in the die and another workpiece on the support rails 138 at unload position 98. Thereafter, when the carriage retracts to the left, the ends of the finger bars in the die area retract into the loading station 96 where a workpiece W has been deposited on support rails 140. Then, as slide 66 begins to move toward the right as viewed in FIG. 6, the lower bar 106 is shifted toward the right to raise the upper bar 104 and thereby lift the workpieces at loading station 96, at the die and at unload position 98 so that each of the workpieces can be advanced in a direction toward the right with carriage 40.

As was true of the embodiment of the invention previously described, the transfer mechanism illustrated in FIGS. 6 to 11 can be adjusted very simply to accommodate a different workpiece. Housings 114 can be mounted on cross arm 42 at any desired position and guide blocks 112 can likewise be mounted in the die area of the press at a desired location. Likewise, finger-operating rods 120 can be connected to either end of control rods 74 and replaced with others of different length to accommodate different sized workpieces. In addition, if housings 114 are designed for right-hand and left-hand operation both gear racks 118 can be connected to the opposite ends of the same control rod 74.

It will be apparent that the transfer mechanism shown and described herein is admirably suited for use with different stamping presses and can be modified in a simple manner to accommodate workpieces of different shapes and sizes. The flat top face 43 of cross arm 42 enables the housings 82, 114 to be mounted thereon at any desired location either by locating them at predrilled holes or by drilling additional holes through the cross arm at the desired locations. If desired, the mounting holes on the cross arm can be in the form of elongated slots or the like extending lengthwise of the cross arm. Any arrangement which enables the housings to be mounted on the cross arm at any desired location may be employed.

It will also be noted that by supporting the free ends of the finger bars by guide members mounted in the die area and by causing the fingers on the finger bars to move in vertical planes either transverse or parallel to the finger bars, rather than horizontally toward and away from the die, the transfer mechanism disclosed herein occupies a minimum of space.

I claim:

1. In combination with a metal stamping press, a transfer mechanism for moving workpieces between an idle station spaced from the die in the press and a working station at the die, said transfer mechanism comprising a base extending from and adapted to be fixedly connected to the press, a carriage guided for reciprocation on said base in a horizontal rectilinear path toward and away from the die, said carriage comprising a horizontally disposed rigid cross arm extending transversely of the path of travel of the carriage, means for reciprocating the carriage on said base through a predetermined stroke along said path of travel between advanced and retracted positions, said cross arm having means thereon defining a pair of support surfaces, a pair of support means mounted on said support surfaces in fixed spaced relation, said support means being adjustable lengthwise on said cross arm support surfaces to vary the spacing therebetween to a predetermined desired distance, a pair of horizontally disposed finger bars extending in parallel spaced relation lengthwise of the path of travel of the carriage, each finger bar being connected at one end to one of said support means in an axially and transversely fixed position so that the finger bars are spaced apart to correspond with the adjusted spacing between the support means and are reciprocated lengthwise in parallel fixed relation in response to reciprocation of the carriage, said finger bars extending from said cross arm into the die area of the press, guide means fixedly mounted relative to the press in spaced, transversely adjustable relation to correspond with the adjusted spacing between said support means, said guide means slideably supporting the other ends of said finger bars for lengthwise reciprocation in parallel relation, said finger bars having work-engaging fingers thereon, means mounted on and movable with said support means for moving said fingers in one direction to engage a workpiece extending transversely between the two finger bars and thereby advance the workpiece horizontally when the carriage is thereafter reciprocated in one direction, said fingers being movable in the opposite direction to release the workpiece and bypass the same when the carriage is thereafter reciprocated in the opposite direction, a drive mechanism mounted on said carriage between said support means, means mounted on and movable with said cross arm for actuating said finger moving means in timed relation with the reciprocation of said carriage, said actuating means extending between said drive mechanism and said finger moving means for establishing a driving connection therebetween, the spacing between said finger bars being variable by means of the transverse adjustability of said support means and said guide means to accommodate workpieces of different sizes and said actuating means being variable in length for establishing a driving connection between said drive mechanism and said finger moving means in accordance with the adjusted spacing between said support means.

2. The combination called for in claim 1 wherein said support means comprises a pair of spaced apart housings mounted on said cross arm and said means for moving said fingers are disposed in said housings and operatively interconnect said finger bars and said finger actuating means.

3. The combination called for in claim 1 wherein the means mounting the finger bars on the cross arm include said means for moving the work-engaging fingers.

4. The combination called for in claim 1 wherein said drive mechanism has a pair of output members on said carriage reciprocated in a direction transversely to the path of travel of the carriage, said finger actuating means comprising a pair of finger operating rods each releasably connected at one end to one of said output members and releasably connected at their other ends to the finger moving means whereby the finger rods can be replaced with others of different length when the spacing between the finger bars is changed to accommodate a different workpiece.

5. The combination called for in claim 4 including couplings releasably connecting the output members with said one end of each of the finger operating rods.

6. The combination called for in claim 4 wherein the output members are reciprocated simultaneously in opposite directions.

7. The combination called for in claim 4 wherein said drive mechanism includes at least one shaft which is reciprocated in a direction transversely of the path of travel of the carriage, said output members comprising the opposite ends of said shaft.

8. The combination called for in claim 4 wherein said drive mechanism comprises at least two parallel finger control rods each of which is reciprocated axially in a direction transverse of the path of travel of the carriage, said output members comprising the ends of said control rods.

9. The combination called for in claim 8 wherein the opposite ends of each control rod are accessible for connection with the finger operating rods.

10. The combination called for in claim 8 wherein said finger operating rods are connected one to each control rod.

11. The combination called for in claim 1 wherein said support means and the means for moving the fingers comprise a pair of drive housings mounted one on each end portion of the cross arm, each drive housing including an input member and an output member, said output members being operatively connected with said finger bars, said input members being adapted to be reciprocated to actuate said output members, said actuating means comprising a pair of finger operating rods extending lengthwise of the cross arm and releasably connected at one end to said input members and releasably connected at their other ends to said drive mechanism, said drive mechanism being adapted to reciprocate the rods axially whereby said finger operating rods can be replaced with others of different length to accommodate a different spacing between said drive housings.

12. The combination called for in claim 11 including releasable couplings connecting the opposite ends of said finger operating rods to said input members and means on the carriage for reciprocating said rods.

13. The combination called for in claim 1 wherein said support surfaces are of uniform configuration and extend lengthwise of said cross arm, said support means comprising a pair of housings having mounting surfaces which mate with said support surfaces on the cross arm to enable mounting the housings at any desired fixed location along the length of the support surfaces.

14. The combination called for in claim 13 wherein the support surfaces of said cross arm and said housings comprise generally flat faces in coplanar engagement.

15. The combination called for in claim 1 wherein said drive mechanism has a pair of output members reciprocated in a direction transversely to the path of travel of the carriage, said finger actuating means comprising a pair of finger-operating rods each releasably coupled at one end to one of said output members, an input stub shaft on each of said housings extending transversely of each finger bar towards the carriage, and couplings releasably connecting the other end of each finger-operating rod with said stub shafts whereby said couplings may be released and said finger-operating rods may be replaced with a different set of different length when it is desired to mount the housings on the cross arm with a different spacing therebetween.

* * * * *